US009909330B2

(12) United States Patent
Gray et al.

(10) Patent No.: US 9,909,330 B2
(45) Date of Patent: Mar. 6, 2018

(54) METHOD AND APPARATUS TO FILL AND FIRE PROOF HOLES IN CONCRETE FLOORS

(71) Applicants: Gerald R. Gray, Costa Mesa, CA (US); Robert W. Johnson, Costa Mesa, CA (US)

(72) Inventors: Gerald R. Gray, Costa Mesa, CA (US); Robert W. Johnson, Costa Mesa, CA (US)

( * ) Notice: Subject to any disclaimer, the term of this patent is extended or adjusted under 35 U.S.C. 154(b) by 0 days.

(21) Appl. No.: 15/674,404

(22) Filed: Aug. 10, 2017

(65) Prior Publication Data

US 2017/0370115 A1 Dec. 28, 2017

Related U.S. Application Data

(63) Continuation-in-part of application No. 15/153,669, filed on May 12, 2016, now abandoned, which is a continuation-in-part of application No. 14/584,981, filed on Dec. 29, 2014, now Pat. No. 9,366,044, which is a continuation of application No. 13/854,795, filed on Apr. 1, 2013, now Pat. No. 8,959,863.

(60) Provisional application No. 61/650,179, filed on May 22, 2012.

(51) Int. Cl.
*E04G 23/02* (2006.01)

(52) U.S. Cl.
CPC ..... *E04G 23/0288* (2013.01); *E04G 23/0203* (2013.01); *E04G 23/0285* (2013.01)

(58) Field of Classification Search
CPC ..... E04G 23/0203; E04G 23/0288; E04G 23/0285; E04G 15/04
See application file for complete search history.

(56) References Cited

U.S. PATENT DOCUMENTS

| | | | |
|---|---|---|---|
| 2,052,384 | A | 8/1936 | Conran |
| 3,300,943 | A | 4/1967 | Owens |
| 3,722,037 | A | 3/1973 | Jaeger |
| 3,727,271 | A | 4/1973 | Znamirowski |
| 3,811,175 | A | 5/1974 | Gamer et al. |
| 3,889,436 | A | 6/1975 | Elliott |
| 4,270,318 | A | 6/1981 | Carroll et al. |
| 4,301,629 | A | 11/1981 | Farr |
| D273,091 | S | 3/1984 | Kurosaki |
| 4,674,255 | A | 6/1987 | Derome |
| 4,713,129 | A | 12/1987 | Inhofe, Jr. et al. |
| 4,754,590 | A | 7/1988 | Gordon |

(Continued)

*Primary Examiner* — Brian E Glessner
*Assistant Examiner* — Daniel J Kenny
(74) *Attorney, Agent, or Firm* — Jafari Law Group, Inc.

(57) ABSTRACT

The present apparatus and method relates in general to sealing a hole in a floor with a precast plug. A precast plug is created by pouring a wet aggregate mix into a form mold and thereafter inserting a pre formed rod into the uncured mixture, positioning it such that the center of the rod rests in the center of the form mold and the ends of the rod extend outward near the top of the form mold. The mix is then cured. The precast plug may then be transported to the hole that it is destined to fix. Grooves may be carved on either side of the hole to accommodate the rod's ends. The interior of the hole and the exterior of the plug may then be covered with a sealant, after which the plug may be inserted into the hole. Once the sealant cures, the hole is fully repaired.

18 Claims, 14 Drawing Sheets

(56) References Cited

U.S. PATENT DOCUMENTS

| | | | |
|---|---|---|---|
| 4,807,415 | A | 2/1989 | Oak |
| 4,823,978 | A | 4/1989 | Pufpaff |
| 5,018,331 | A | 5/1991 | Forzano |
| 5,103,615 | A | 4/1992 | Owens |
| 5,327,942 | A | 7/1994 | Black |
| 5,344,268 | A | 9/1994 | Fischer |
| 5,499,737 | A | 3/1996 | Kraus |
| 5,624,615 | A | 4/1997 | Sandorft |
| 5,992,858 | A | 11/1999 | Teaster |
| 6,797,354 | B2 | 9/2004 | Fleck |
| 6,918,219 | B1 | 7/2005 | Olson |
| 6,955,015 | B2 | 10/2005 | Mathei |
| D553,717 | S | 10/2007 | Nicholson |
| 7,347,655 | B2 | 3/2008 | Nagasawa et al. |
| 7,380,382 | B2 | 6/2008 | Hansen |
| 7,455,192 | B2 | 11/2008 | Siragusa |
| 7,581,361 | B1 | 9/2009 | Murkland |
| D617,178 | S | 6/2010 | Sakai |
| 7,797,892 | B2 | 9/2010 | Cannistraro |
| 7,836,659 | B1 | 11/2010 | Barnes |
| D632,550 | S | 2/2011 | Watanabe |
| D638,103 | S | 5/2011 | Roll |
| 7,984,595 | B2 | 7/2011 | Reen |
| 8,256,988 | B1 | 9/2012 | Haber |
| 9,169,643 | B2 * | 10/2015 | Dryburgh ..... B28B 7/0014 |
| 2002/0102381 | A1 | 8/2002 | McClurg |
| 2007/0113490 | A1 | 5/2007 | Boyd |
| 2008/0028696 | A1 | 2/2008 | Fennell |
| 2008/0196562 | A1 | 8/2008 | Elliston et al. |
| 2008/0314902 | A1 | 12/2008 | Dayton et al. |
| 2009/0320391 | A1 | 12/2009 | Stubblefield et al. |
| 2011/0023395 | A1 | 2/2011 | Hoshi |
| 2011/0110743 | A1 | 5/2011 | Heimer |
| 2012/0124796 | A1 | 5/2012 | Ibanez Ceba |

* cited by examiner

METHOD AND APPARATUS TO FILL AND FIRE PROOF HOLES IN CONCRETE FLOORS

PRIORITY AND CROSS-REFERENCE TO RELATED APPLICATIONS

The present application is a continuation-in-part of U.S. patent application Ser. No. 15/153,669, filed on May 12, 2016, which is a continuation-in-part of U.S. patent application Ser. No. 14/584,981, filed on Dec. 29, 2014, which is a continuation of U.S. patent application Ser. No. 13/854,795, filed on Apr. 1, 2013, now U.S. Pat. No. 8,959,863, which claims the benefit of U.S. Provisional Patent Application 61/650,179, filed on May 22, 2012, the disclosures of each incorporated herein by reference in their entirety.

TECHNICAL FIELD OF THE INVENTION

The present invention relates in general to a method and apparatus for filling and fire-proofing holes in concrete floors, and more specifically, to a method for utilizing an apparatus or precast plug to repair and restore holes.

COPYRIGHT & TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Typically, a condition in a lease contract between a commercial building owner and a tenant is that at the end of the lease the tenant must return the leased premises in the same condition that it was in at the time the tenant took possession, save for normal wear and tear. During the course of a tenancy, a lessee will typically cause numerous holes to be drilled into the concrete floor and/or ceiling of his suite to accommodate the routing of electrical wires, plumbing pipes, voice cables, and other such items that run through the floors. In the great majority of mid and high rise office buildings, these floors are constructed of a lightweight aggregate poured on a metal underlayment or pan. This flooring assembly provides a fire break between floors. When the tenant vacates the premises, the drilled holes during the tenancy are left wide open as a result of the removal of the wiring, plumbing, etc. that had been previously installed. This is potentially a breach of the fire control properties of the flooring assembly. These holes are typically three to four inches in diameter, but can range up to twelve inches or larger. Until recently, most property owners did not recognize this as a problem, and as a result did not require the vacating tenant to repair and restore these holes. More recently, it has been recognized, however, as an issue that must be remedied before a new tenant can take possession of the property.

There are several products on the market that can be used to restore the fire break properties of the flooring assembly. Most utilize a mechanical closure of the hole by installing an expandable metal plug or cap, and require that they be installed through the bottom of the hole. This solution often requires that access to the underside of the floor be granted by another tenant or the owner. Such access may be disruptive, cause security and liability issues, necessitate that the repair work be performed after normal working hours, and cause possible damage to another tenant's property. The parts and labor associated with these products tend to be rather expensive as well.

Another problem with other products is that the final repair results in a protruding floor surface. This is a design flaw that complicates future use of the floor where the protrusion is located.

Yet another problem related to repairing holes after a lease has expired is shoddy repair work. To honor the lease, a tenant may merely stuff a rag or other such material in the hole and then fill it with a plaster, such as FIX-IT-ALL™. Such a repair is insufficient, as there is nothing to keep the rag and plaster from falling through the floor into the suite below. Moreover, such a repair may be prone to water leaks and likely does not conform to the fire code, and testing these properties would be overly burdensome, defeating the purpose of the repair in the first place.

Therefore, there are several problems with the current state of the art, which have not been adequately addressed. The problems persist because a need to provide a method and apparatus for filling & fire-proofing holes in concrete floors has not been adequately met. It is to these ends that the present invention has been developed.

BRIEF SUMMARY OF THE INVENTION

To minimize the limitations in the prior art, and to minimize other limitations that will be apparent upon reading and understanding the present specification, the present invention describes a method and apparatus (or precast plug) for sealing a hole in a floor comprising a concrete housing and at least one rod whereby the distal end of said at least one rod makes at least one protrusion from at least one edge of said concrete housing.

An apparatus, in accordance with an exemplary embodiment of the present invention, comprises: a concrete housing configured to substantially seal a hole in the floor of a building; a rod situated within the concrete housing, the rod including a first and second portions protruding from the concrete housing, wherein the first and second portions are configured to register with one or more grooves on the surface of the floor and adjacent to the hole; and a support component coupled to the rod, the support component embedded within the concrete housing.

A method, in accordance with an exemplary embodiment of the present invention, comprises: dry-fitting a precast plug into a hole of a floor assembly; drawing an outline of one or more rods that extend from the concrete housing of the precast plug; creating grooves adjacent to he hole, the grooves configured to receive portions of the rod external to the concrete housing; applying a sealant to the interior surface of the hole; applying sealant to the concrete housing of the precast plug; and inserting the precast plug into the hole in a manner so that: the external portions of the rod register with the grooves adjacent to the hole, and the external portions of the rod are substantially flush with the surface of the floor.

Another method, in accordance with an exemplary embodiment of the present invention, comprises: preparing a wet cement mixture; pouring said wet cement mixture into a form mold housing; installing into said form mold housing a first rod whereby the distal end of said first rod makes a first protrusion from a first edge of said form mold housing and the proximal end of said first rod makes a second protrusion from a second edge of said form mold housing; allowing said mixture to cure with said first rod in place, thereby creating said pre-cast plug; grinding a first and second groove into said floor to house said distal and proximal ends of said first rod; coating said precast plug's edges with said sealant; placing said precast plug into said hole such that the distal and proximal ends of said first rod rest in said first and second grooves; and allowing said sealant to cure.

It is an objective of the present invention to seal a hole in a floor such as to make it fire resistant, water resistant, and structurally sound.

It is another objective of the present invention to allow for ease of installation, making a repair job quick and efficient.

It is yet another objective of the present invention to repair a hole in a floor, such that the apparatus is flush with the floor's surface.

These and other advantages and features of the present invention are described herein with specificity so as to make the present invention understandable to one of ordinary skill in the art.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the apparatus and method.

FIG. 11(*a*) is a perspective view of yet another embodiment of an apparatus similar to the apparatus depicted in FIG. 11.

FIG. 11(*b*) is a cross-sectional side view of the embodiment of the apparatus depicted in FIG. 11(*a*).

FIG. 11(*c*) is a three-dimensional exploded cross-section view depicting the apparatus illustrated in FIG. 11(*a*)-11(*b*), before it is place in said hole.

DETAILED DESCRIPTION OF THE INVENTION

Figure 1:
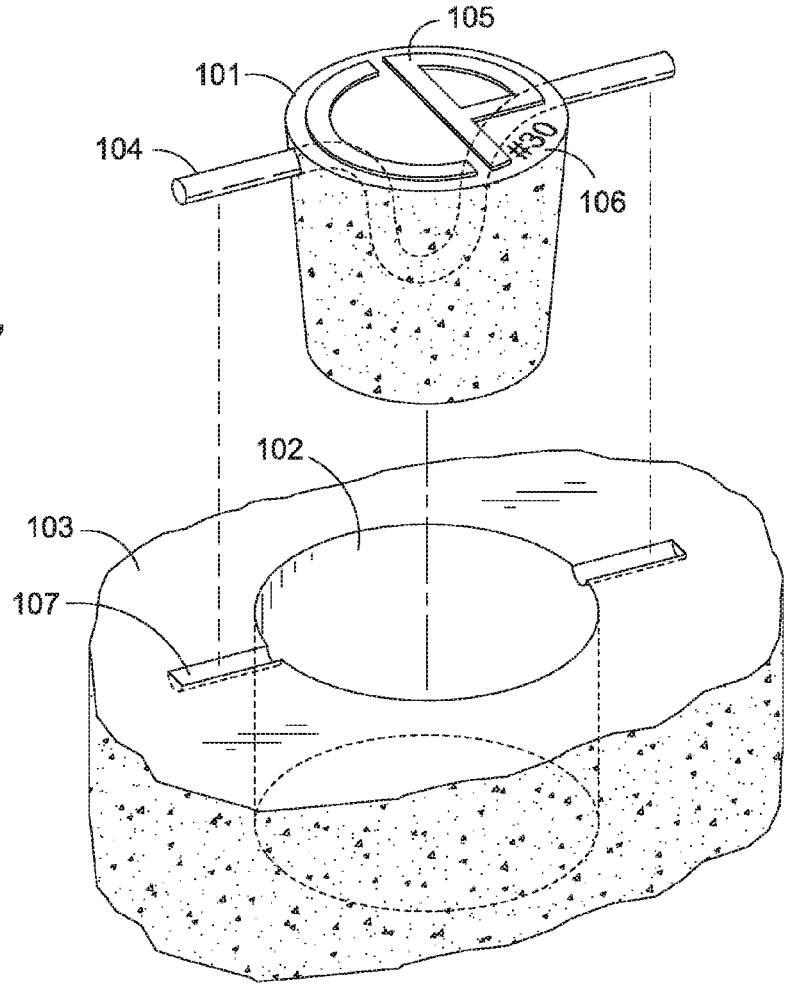
FIG. 1 is a three dimensional exploded cross-section view depicting an apparatus, in accordance with an exemplary embodiment of the present invention, above a cutout section of a floor assembly with a hole, before it is place in said hole.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

FIG. 1 is a three dimensional exploded cross-section view depicting an apparatus, in accordance with an exemplary embodiment of the present invention, above a cutout section of a floor assembly with a hole, before it is place in said hole. More specifically, FIG. 1 depicts precast plug 101 before it is placed in hole 102. This embodiment is a basic depiction of how precast plug 101 may function, namely to seal hole 102. It also depicts the various components of precast plug 101 including rod 104.

Precast plug 101 may be constructed off site, i.e., from where the hole it intends to repair is located. However, this is not to limit the scope of precast plug 101. If a particular location required precast plug 101 to be made on site, such as a remote location and time was of the essence, this could be accomplished by making precast plug 101 at the site of hole 102.

In either case, precast plug 101 may be constructed of the same material as floor 103, which in the typical scenario will be a lightweight aggregate or other cement, which has fire and water resistant properties in addition to structural integrity, similar to floor 103. For example, Rapid Set® Cement All™ may be used to construct precast plug 101, but this is not to limit the scope of the apparatus and method. In another embodiment, precast plug 101 may be constructed of plastic, steel, or any other material suitable for filling a hole or cavity. Where a cement-like material is used to prepare precast plug 101, it may be mixed with the requisite amount of water (and coloring if desired) to form a wet mixture. This mixture may then be poured into a form mold.

The shape and size of form mold, and therefore precast plug 101, may vary depending upon the type of repair job—for example, this may depend on the thickness of the floor assembly needing repair. The embodiment depicted in FIG. 1 shows precast plug 101 as having a cylindrical shaped housing with a top planar surface, an outer wall, and a bottom planar surface that are integral to and unitarily form the concrete housing. The outer walls may have a slight inward taper from the top of precast plug 101 where logo 105 is located to the bottom of precast plug 101. However, a straight cylindrical form mold may also be employed to create precast plug 101 with no taper. Other embodiments of precast plug 101 may be cast in square, rectangular, triangular, and other variable sized and shaped form molds to create variable sized and shaped precast plugs 101. Precast plug's 101 diameter (or general width) is also variable depending upon the actual size of hole 102 to be repaired. A larger hole may necessitate a larger diameter form mold while a smaller hole may necessitate a smaller diameter form mold. Finally, the height of hole 102 is relevant to the size of the form mold to be used, which in the typical repair job may be three and one half inches. As mentioned above, this may vary depending upon the type of repair job—for example, this may depend on the thickness of the floor assembly needing repair. Typically, the thickness of the floor will vary with 3.5" being the minimum thickness. Nevertheless, exemplary embodiments may be designed to provide a certain fire rating (e.g. a 2.0-hour fire rating) when installed according to directions, regardless of actual thickness of floor assembly. The embodiment shown in FIG. 1 depicts precast plug 101 to be of substantially the same height as the height of hole 102, meaning from the top of floor 103 to the bottom of floor 103, however the actual height of precast plug 101 may vary. In exemplary embodiments, the height of the concrete housing is the minimum height of the hole.

Before the cement mixture cures in the properly sized form mold, an appropriately sized rod 104 may be inserted into the wet cement housing of precast plug 101. Rod 104 may be comprised of any number of materials, including steel, plastic, multiples of rods, etc., as will be further discussed below. As depicted in FIG. 1, rod 104 may be constructed of steel and may also be bent or molded such that it forms a "C" like shape in the center of rod 104. This allows for the "C" portion of rod 104 to be fully embedded within the form mold cement mixture, and the ends of rod 104 to extend from either side of what is soon to become precast plug 101 after curing. The ends, or "wings" of rod 104, may give precast plug 101 support when resting in hole 102 and prevent precast plug 101 from falling through the floor.

Precast plug 101 may also be embossed as depicted in FIG. 1 with logo 105 before cement mixture cures. However, this is not to limit the scope of the invention. Logo 105 may also be a stamp, painting, etching, or any other mark to indicate who made precast plug 101. In FIG. 1, logo 105 consists of a capital "C" and a capital "P" indicating for example, a trademark. However, logo 105 may also consist of other combinations of letters, numbers, symbols, and/or pictures.

Precast plug 101 may also be stamped, as depicted in FIG. 1, with size indicator 106. Again, size indicator 106 may also be embossed, painted, etched, or generally engraved in such a way that it clearly communicates information about precast plug's 101 and/or hole's 102 dimensions. In FIG. 1, it may be noted that size indicator 106 is represented by a "#30". This may be a shorthand method of indicating that hole 102 is three inches for example. It could also be used to communicate that the width of precast plug 101 is three inches, if that would be a preferable method of measuring. However, other methods of communicating the size of precast plug 101 or the size of hole 102 may be employed such as a size indicator 106 depiction of "(3")" or "3 In.".

Logo 105 and size indicator 106 may also be used to communicate other desirable information, such as implied information. Implied information may be apprised from both logo 105 and size indicator 106 to indicate to appropriate authorities, such as a fire marshal, that the plug that is going to be installed or already has been installed into floor 103 is of such a quality and design that it meets appropriate fire codes and/or other safety regulations. Accordingly, information that may be stamped, embossed, or otherwise applied to the housing of precast plug 101 may include a batch control number, a date of manufacture, or any other pertinent information that may be useful to an installer, inspector, or user of the apparatus.

Further depicted in FIG. 1 are grooves 107 on either side of hole 102. Grooves 107 may not be preexisting. If not, grooves 107 may be ground out, for example, with an angle grinder, chiseled with a chisel, or carved out using some other device, tool or mechanism to accommodate the portions of rod 104 that are situated external to the concrete housing—or "wings" of rod 104. Once the appropriate number of grooves 107 are carved out (and in the proper places), precast plug 101 may be inserted into hole 102 such that each "wing" of rod 104 may rest snugly within its own groove 107 and the top of precast plug 101 may rest flush with floor 103. This may be desirable for several reasons, including so that the finished repair does not protrude above the floor surface—this facilitates installation of finish floor surface material.

In another embodiment, rather than utilizing the technique of grooves 107, holes may be drilled in either side of the wall of hole 102, beneath the surface of floor 103. Similar tools may be employed as may be used to carve out grooves 107, including a right angle drill. Utilizing this technique, it would be possible not only to repair a hole in a floor below one's feet, but also a floor above one's head, i.e. a ceiling. In such a case, various embodiments of precast plug 101 may include logo 105 and size indicator 106 embossed or otherwise marked on the bottom side of precast plug 101, or rather on both ends of precast plug 101 to make it visible to one viewing precast plug 101 from above or below. The "wings" of rod 104 may also extend from a more central portion of precast plug 101 rather than being substantially flush with the top of precast plug 101. To accommodate the "wings" of rod 104 it may be necessary to drill deeper holes on either side of hole 102. After drilling the holes, one "wing" of rod 104 may be fully inserted into said drilled hole such that the side of precast plug 101 and interior of hole 102 are flush and the other "wing" of rod 104 is fully within hole 102 and extended in the direction of the drilled hole that it is to occupy. The entirety of precast plug 101 may then be laterally moved in that direction such that it is centered in hole 102 and both "wings" of rod 104 come to rest in either drilled hole.

Figure 2:
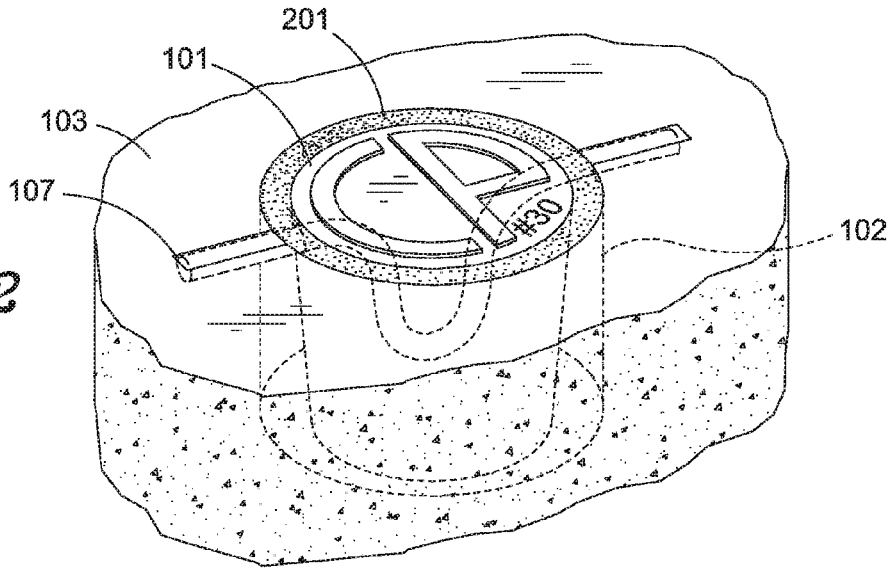
FIG. 2 is a three dimensional cross-section view of an apparatus that has been placed in a hole in a cutout section of a floor assembly.

FIG. 2 is a three dimensional cross-section view of precast plug 101, which has been placed in hole 102 of floor 103. This embodiment is a basic depiction of how precast plug 101 functions, i.e. to seal hole 102 such that hole 102 is fire resistant, water resistant, and structurally sound. FIG. 2 also depicts how the top portion of precast plug 101 may not protrude from floor 103, but is relatively flush with floor 103. FIG. 2 further depicts how the bottom of precast plug 101 may be flush with the bottom side of floor 103.

Before appropriately sized precast plug 101 is fitted into hole 102, however, sealant 201 may be beaded around the exterior wall of precast plug 101 and the interior wall of hole 102, after which precast plug 101 may be fitted into hole 102. Once the wings of rod 104 are snugly within grooves 107, sealant 201 may be inserted into any voids such that hole 102 is completely full and/or excess sealant 201 may be wiped away from the area of hole 102. Sealant 201 may also be applied over the top of the wings of rod 104 to further secure rod 104 in place. After sealant 201 cures, what is left is a fire resistant, water resistant, and structurally sound repair job, which may be impliedly indicated by logo 105 as discussed above. As an example, 3M™ Fire Barrier Sealant IC 15WB+ or CP 25WB+ may be used as sealant 201, however, this is not to limit the scope of the invention. Other products with similar properties may be employed in lieu of said brand. Typically, the sealant used should comply with fire stop properties in accordance with jurisdictional codes or well-known standards (for example as set forth in ASTM E 814-13a).

Figure 3:
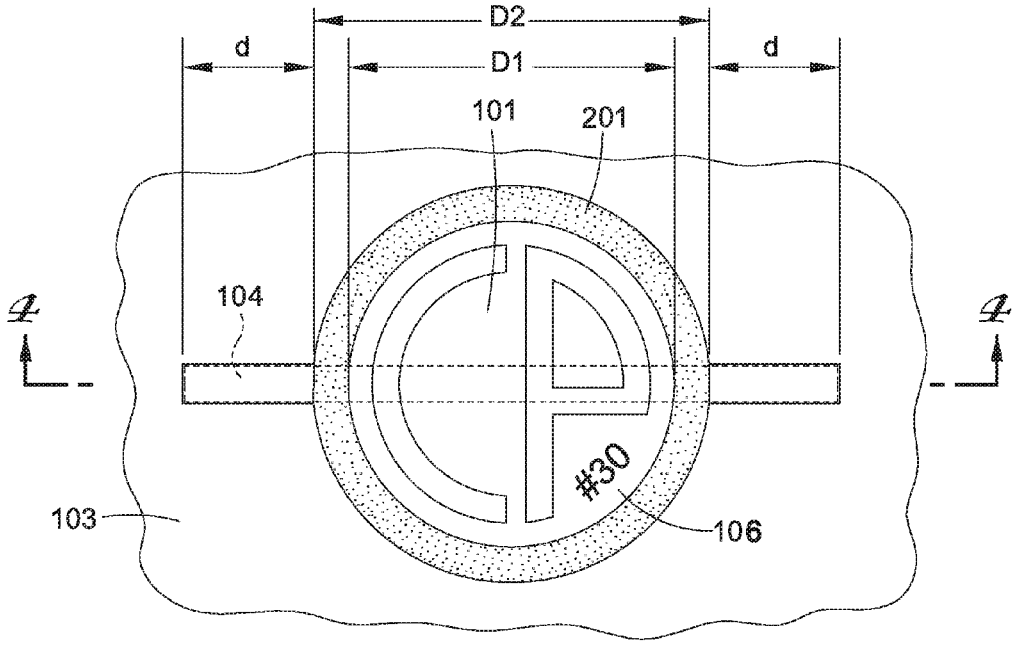
FIG. 3 depicts a top view of an apparatus used to fill a hole, in accordance with an exemplary embodiment of the present invention, fully installed into a hole.

FIG. 3 depicts a top view of precast plug 101 fully installed into hole 102 in a cutout section of floor 103. FIG. 3 also introduces another aspect of the present invention, namely, various dimensions of an apparatus in accordance with the present invention. Before installation of precast plug 101, it may be necessary to measure the size of hole 102 that is to be repaired. For example, size indicator 106 depicts a "#30", which may mean that before installation, it was measured that the size of hole 102 to be repaired was three inches. In such a case, whatever the width of hole 102 may be, D2 represents this dimension. D1 represents the width of precast plug 101. Finally, both d's represent the portion of how far rod 104 extends into floor 103. Depending upon the nature of the repair to be made, any and all of these dimensions may be lengthened or shortened to accommodate the repair. FIG. 3 also depicts sealant 201 surrounding precast plug 101. Sealant 201, however, may also be applied over the top rod 104 to give further stability.

Figure 4:
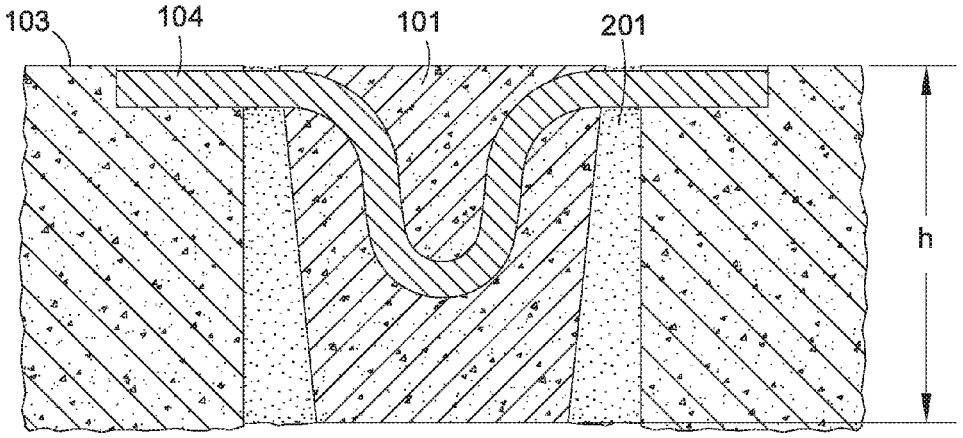
FIG. 4 depicts a cross-sectional side view of the apparatus as shown in FIG. 3.

FIG. 4 depicts a cross-sectional side view precast plug 101 fully installed into hole 102 in a cutout section of floor 103. The location of the cross section is indicated in FIG. 3 by the 4-4 cross-section line. As can be seen in this embodiment, rod 104 has a "C" shaped bend allowing for rod 104 to penetrate into the center of precast plug 101. This bend into the center of precast plug 101 allows for rod 104 to lend structural support to precast plug 101. Also seen from this view, the wings of rod 104 extend into floor 103 on either side of precast plug 101, where grooves 107 may have been chiseled or carved to allow for proper installation of precast plug 101. This embodiment also depicts the slight inward taper of precast plug 101 at an unspecified degree. However, as mentioned above, this taper is not necessary, and in another embodiment, precast plug 101 may have an outward taper, which may make it easier to apply sealant 201. Another dimension depicted in FIG. 4 is the height h of floor 103. As mentioned above, precast plug 101 may be adapted to accommodate the varying heights of concrete floors in different buildings.

FIG. 4 also depicts sealant 201 as extending from the bottom edge of floor 103 to the top edge of floor 103 and fully encompassing the space between floor 103 and precast plug 101. In another embodiment, less sealant 201 may be applied such that enough is applied to fulfill its purpose, which is to seal hole 102.

Figure 5:
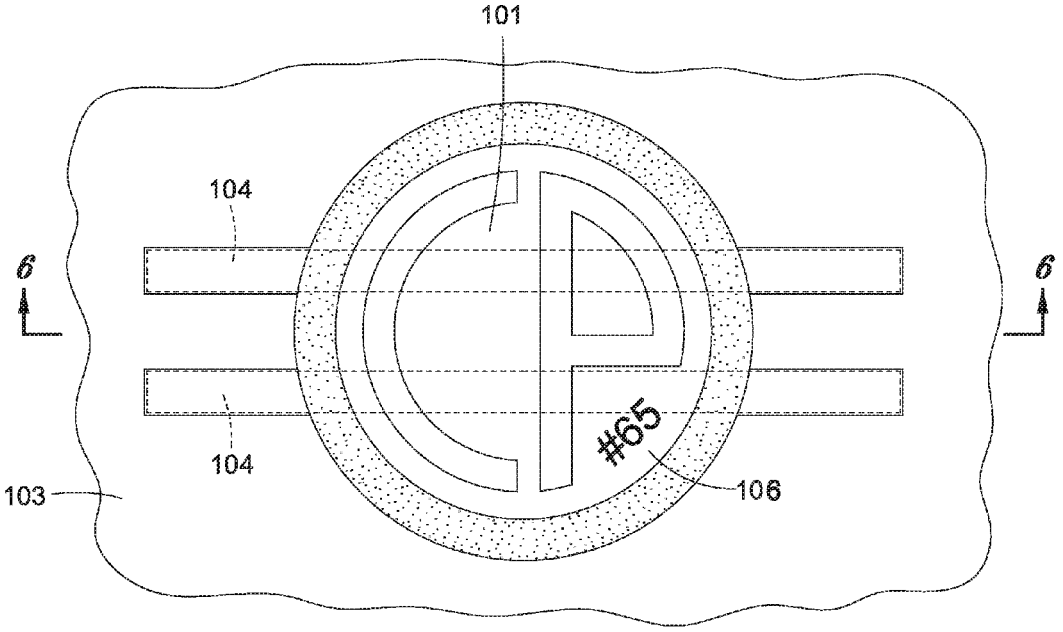
FIG. 5 depicts a top view of an apparatus used to fill a hole, in accordance with another exemplary embodiment of the present invention.

FIG. 5 is a top view depicting an alternative embodiment of precast plug 101 comprising multiple (i.e. two in this embodiment) rods 104 housed within precast plug 101 rather than one as in previous figures. Multiple rods 104 may be suitable to lend further support for a larger precast plug 101 to repair a wider diameter hole 102 or a floor 103 of an increased height. In one embodiment (as shown), multiple rods 104 are substantially parallel to each other and configured to register with grooves (i.e. multiple grooves 107) adjacent to the hole. FIG. 5 depicts a different sized precast plug 101 as indicated by size indicator 106. As discussed above, size indicator may refer to the size of precast plug 101 or the size of hole 102. For example, the "#65" in FIG. 5 may indicate that hole 102 has a diameter of six point five inches.

Figure 6:
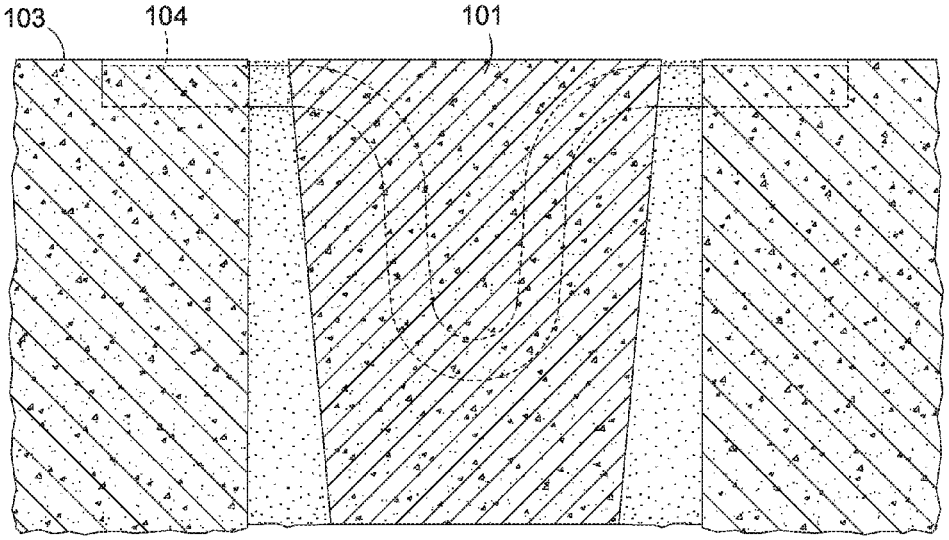
FIG. 6 depicts a cross-sectional side view of the apparatus as shown in FIG. 5.

FIG. 6 depicts a cross-sectional side view of the embodiment shown in FIG. 5. The location of the cross-section is indicated in FIG. 5 by the 6-6 cross-section line. This embodiment generally depicts, however, how multiple rods 104 may be lengthened and positioned in order to accommodate a larger precast plug 101 that may be situated in a deeper hole 102 as may be the case with floor 103 of a greater height, such that multiple rods 104 may still penetrate the center of precast plug 104 and lend full support.

Figure 7:
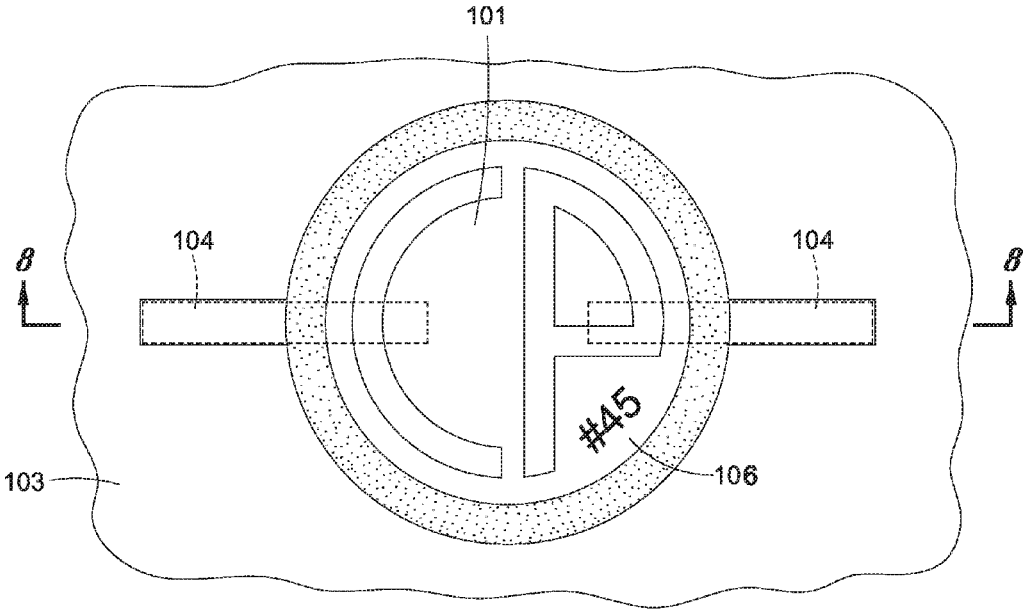
FIG. 7 depicts a top view of an apparatus used to fill a hole, in accordance with another exemplary embodiment of the present invention.

FIG. 7 is a top view of yet another embodiment of the present invention, which also utilizes multiple rods. However, as shown and as clarified further by the 8-8 cross section line in FIG. 8, the two rods 104 act as their own wings so that a pair of rod wings in this embodiment are not part of a single rod. These separate rods 104 may be inserted into precast plug 101 in a similar fashion as described above, i.e., before the wet cement mixture fully cures within the form mold and such that the wings are substantially flush with the top of precast plug 101. In another embodiment, rods 104 may be positioned such that the wings of said rod extend from a central or lower position on either side of precast plug 101, rather than being flush with the top of precast plug 101. Utilizing one of these embodiments, precast plug 101 may be inserted into a ceiling as described above.

Figure 8:
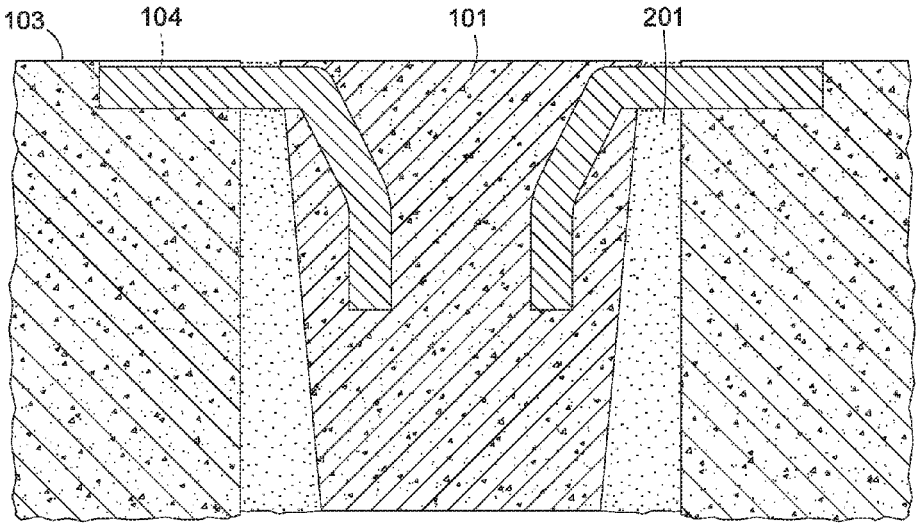
FIG. 8 depicts a cross-sectional side view of the apparatus as shown in FIG. 7.

FIG. 7 further depicts another potential embodiment as represented by size indicator 106, which shows a "#45". This may represent that either hole 102 or precast plug 101 has a width of four and one-half inches. However, the embodiments depicted in FIGS. 7 and 8 are not to be construed as limiting the scope of the present invention. For example, rods 104 in FIG. 7 need not be within substantially the same plane as one another, but may be cured into precast plug 101 in a staggered fashion such that they are rather substantially parallel to one another. In another embodiment, four separate rods 104 similar to those used in FIGS. 7 and 8 may be cured into a single precast plug 101 and arranged in a fashion such that there are two pairs of rods 104 (see FIG. 7 for an example of an arrangement of one pair of rods) with each pair on substantially the same plane when viewed from above and the first pair being substantially parallel with the second pair.

In yet another embodiment, four separate rods 104 similar to the rods 104 depicted in FIGS. 7 and 8 may be cured into precast plug 101 such that each wing when viewed from above would point in a different direction, such as twelve o'clock, six o'clock, three o'clock and nine o'clock substantially bisecting precast plug 101 both vertically and horizontally. With such an embodiment, the method of installation may be modified to account for the requisite number of grooves 107 to house such wings.

Figure 9:
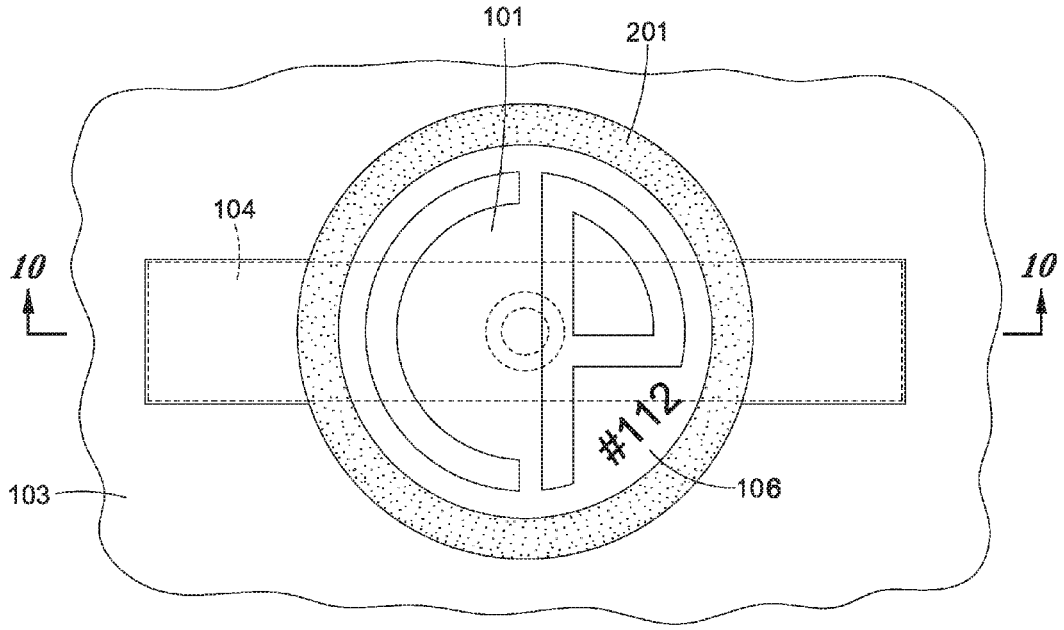
FIG. 9 depicts a top view of an apparatus used to fill a hole, in accordance with another exemplary embodiment of the present invention.

FIG. 9 depicts a top view of an apparatus used to fill a hole, in accordance with yet another exemplary embodiment of the present invention. Rather than a tubular shape as discussed above, rod 104 may take on a substantially rectangular shape. In this embodiment, rod 104 may be comprised of a plastic "T" bar with a break away joint at the "T" intersection, as can be seen in the 10-10 cross section line in FIG. 10. The breakaway joint and base of the "T" of rod 104 may be a cylindrical arrow-like shape. Such an embodiment allows for this breakaway joint and base to grip the housing of precast plug 101, providing additional support so that precast plug 101 does not fall through hole 102. Rod 104 in plastic form, is not to limit the scope of the present apparatus and method. Other embodiments may include iron, wood, silicone, or other durable composite materials. Also, as mentioned above sealant 201 may be applied between precast plug 101 and floor 103, and over the top of rod 104 in the embodiment depicted in FIG. 9.

Figure 10:
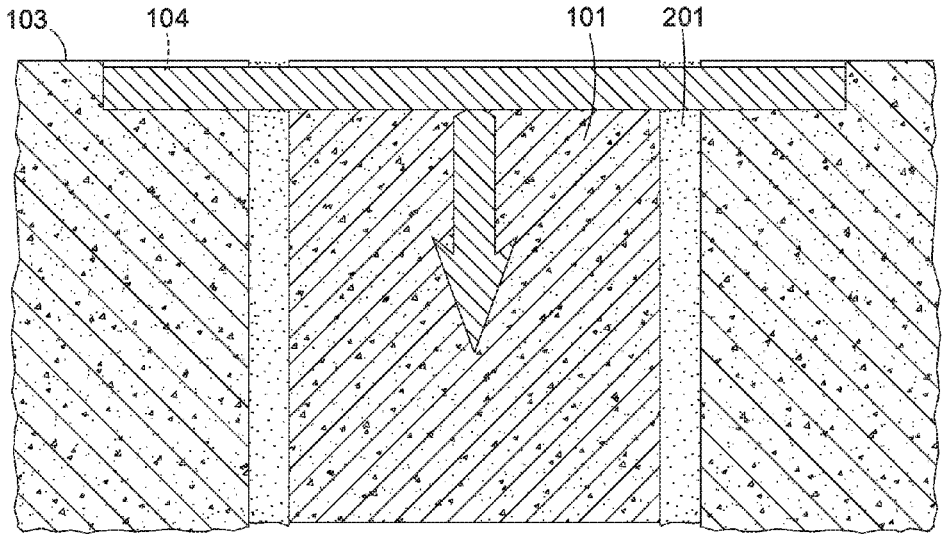
FIG. 10 depicts a cross-sectional side view of the apparatus as shown in FIG. 9.

Size indicator 106 depicts a "#112". As explained above, this may indicate that either hole 102 or precast plug 101 may be eleven point two inches wide for example. FIG. 10 also depicts precast plug 101 with no tapered edge, an alternative embodiment to the present invention. An even column of sealant 201 fills the space between floor 103 and precast plug 101. In another embodiment, however, more or less sealant may be applied, e.g., if precast plug 101 were to taper outward or inward, or hole 102 were to taper inward or outward. In yet another embodiment sealant 201 may be applied such that it covers the bottom edge of precast plug 101 and/or the top edge of precast plug 101, such as to give further protection to precast plug 101 and floor 103.

Figure 11:
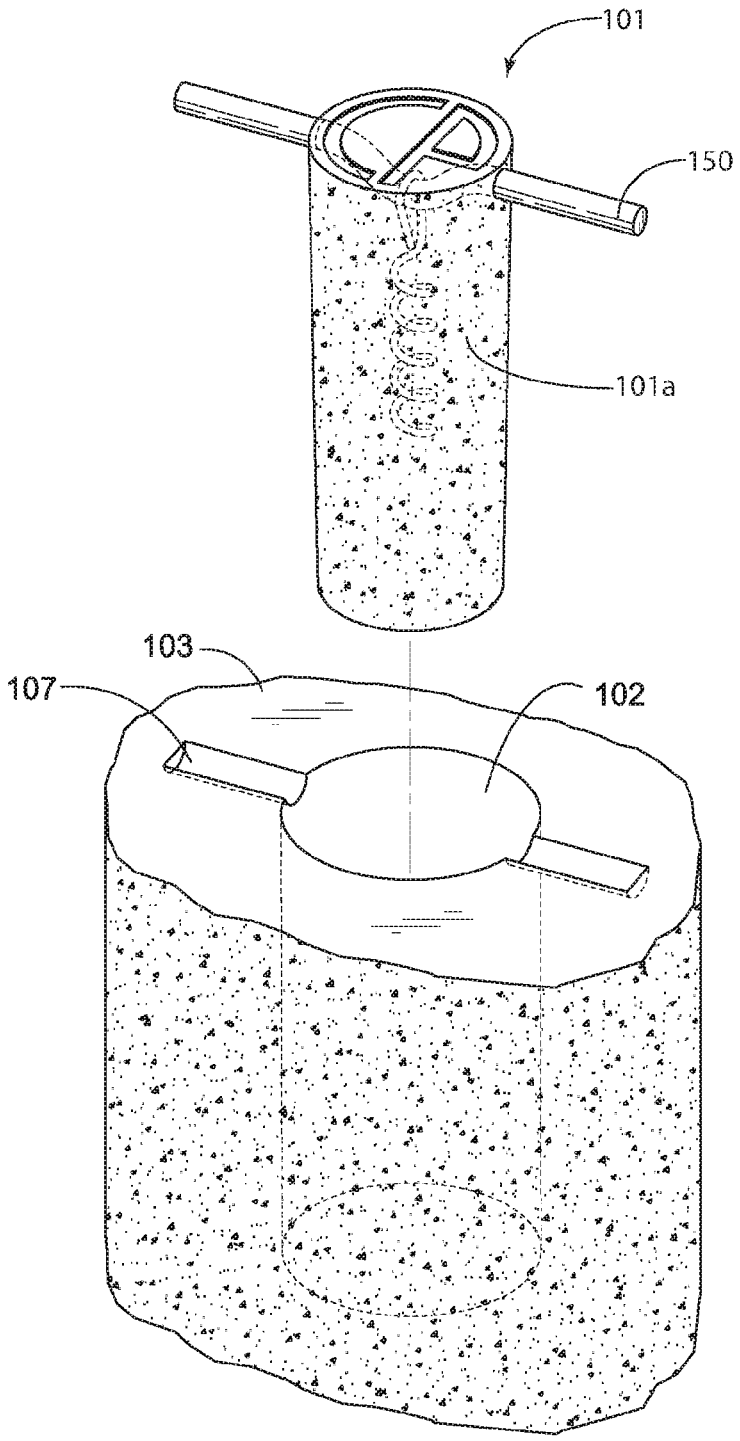
FIG. 11 is a three-dimensional exploded cross-section view depicting an apparatus, in accordance with another exemplary embodiment of the present invention, above a cutout section of a floor assembly with a hole, before it is place in said hole.
Figure 11:
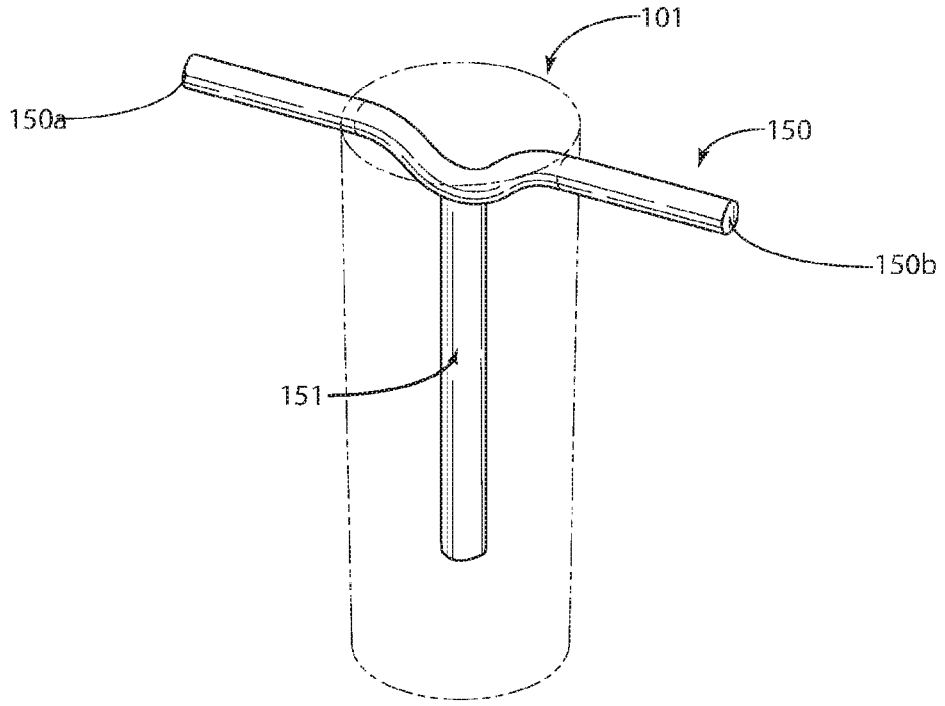
Figure 11:
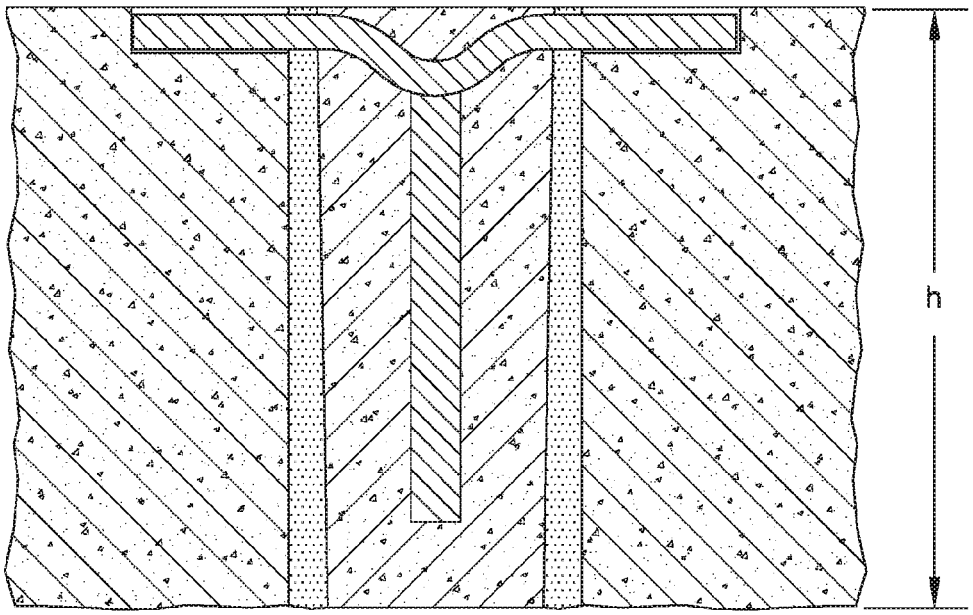
Figure 11:
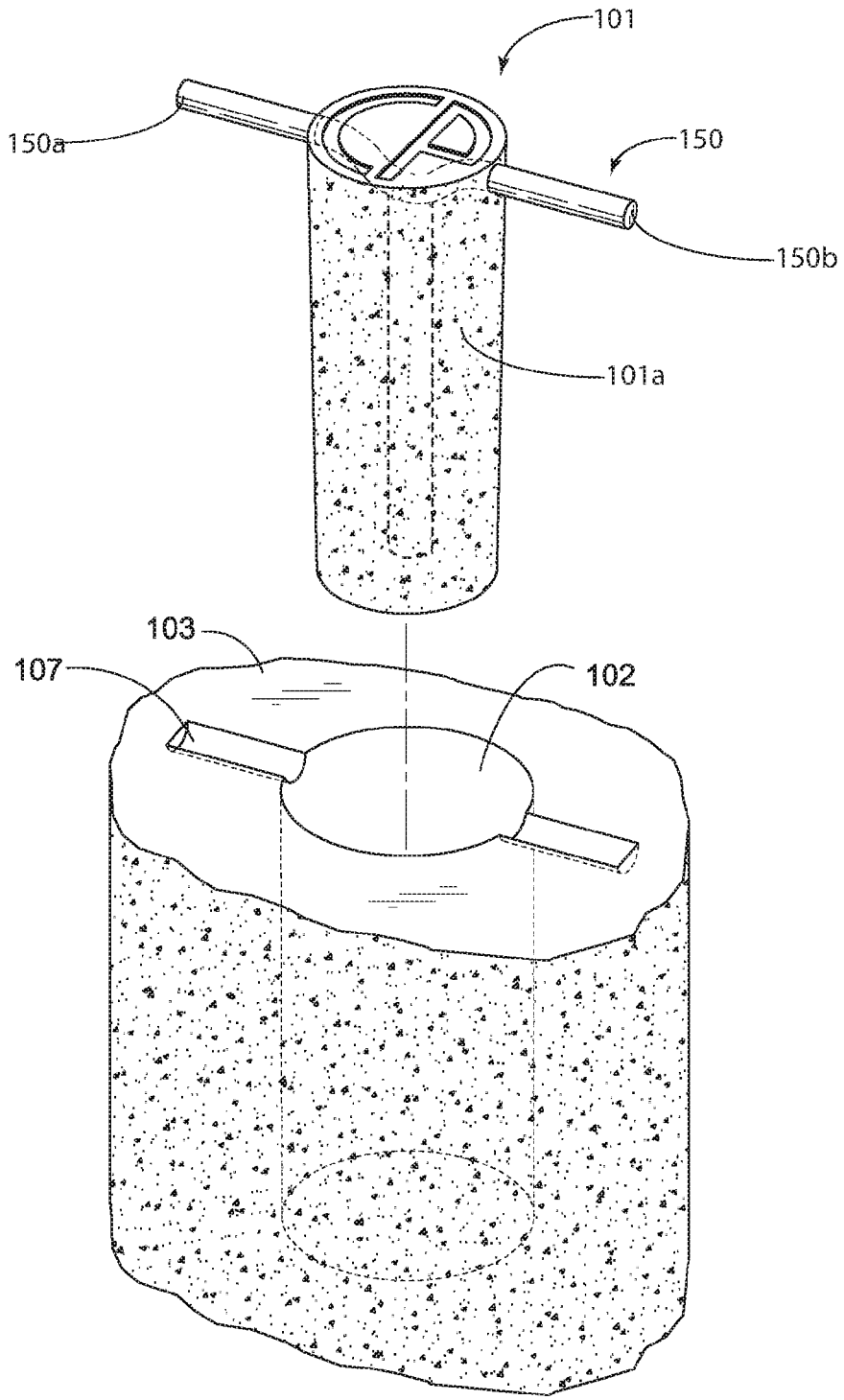

Turning to the next figure, FIG. 11 depicts a three dimensional exploded cross-section view of another exemplary embodiment of precast plug 101, before it is place in hole 102. In this embodiment, precast plug 101 may be adapted for a much narrower construction. That is, there may be certain circumstances in which a narrower housing such as housing 101*a* is preferred. Such embodiments may employ rod 150 rather than rod 104 as shown with reference to FIG. 1. Rod 150 may have a smaller C shape bend, or dip, in a middle portion of the rod to accommodate the narrower construction of housing 101*a*. That is, in instances where housing 101*a* is so narrow that a support rod of appropriate diameter or width may not be easily implemented, precast plug 101 may implement rod 150, which is configured to couple with an anchor or support component 151.

Support component 151 may be a rod with a smaller diameter than rod 150, and which is shaped in a manner so that support component 151 may couple with rod 150—for example at the bend or dip of rod 150. Furthermore, rod 151 may be shaped in a variety of forms in order to provide a keyway that will lock the support component into the concrete housing, thereby providing support for precast plug 101.

Figure 12:
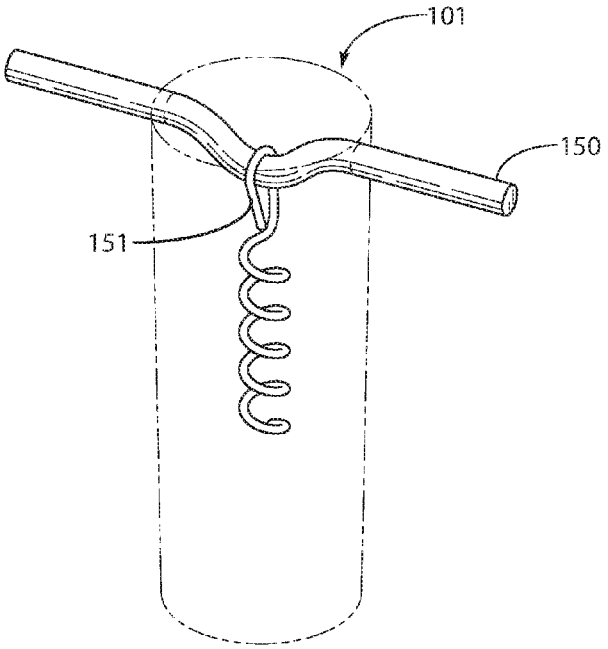
FIG. 12 is a perspective view of the apparatus depicted in FIG. 11, showing a rod situated within a housing, and a support component coupled to the rod.

FIG. 12 is a perspective view of the apparatus depicted in FIG. 11, showing rod 150 and support component 151 situated within housing 101*a*. In this embodiment, support component 151 is helical or having the shape or form of a helix or spiral so that a body of support component 151 may wound or twist uniformly and around in a cylindrical or conical manner. In exemplary embodiments, support component 151 comprises an elongated body such as a rod with a lesser diameter than rod 150, and which is shaped in a manner so that it can be embedded securely within the concrete housing of a precast plug, such as concrete housing 101*a*. Although the shown embodiment includes a shape that twists or is helical in shape, other shapes that allow support component 151 to be embedded securely within concrete housing 101*a* may be implemented.

A top portion of support component 151 may be configured to wrap around or hook onto a portion of rod 150 that is within concrete housing 101*a* of precast plug 101. In exemplary embodiments, a top portion of support component 151 may be hooked or wrapped around, or otherwise coupled to a middle bent portion of rod 150. Of course, other means of coupling the two components may be implemented, including gluing, soldering, or any other manner of securely coupling the support component to the rod. Further, support component 151 may be typically coupled in a manner so that it is substantially perpendicular to rod 150. Of course, other variations may include configurations in which rod 150 and support component 151 are not substantially perpendicular but at other angles in relation to each other. Whatever the configuration, it may be desirable that support component 151 is embedded within an internal portion of the concrete housing of precast plug 101 the will provide the most support—to these ends, in exemplary embodiment, support component 151 may be embedded within a middle portion of the concrete housing.

Figure 13:
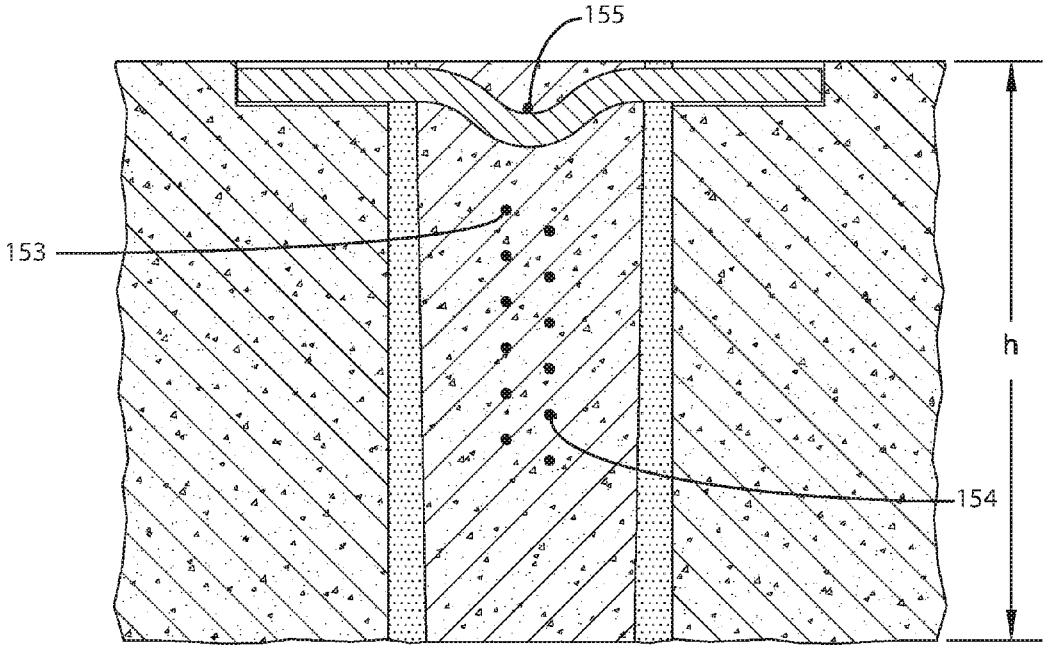
FIG. 13 is a cross-sectional side view of the embodiment of the apparatus depicted in FIG. 12.
Figure 17:
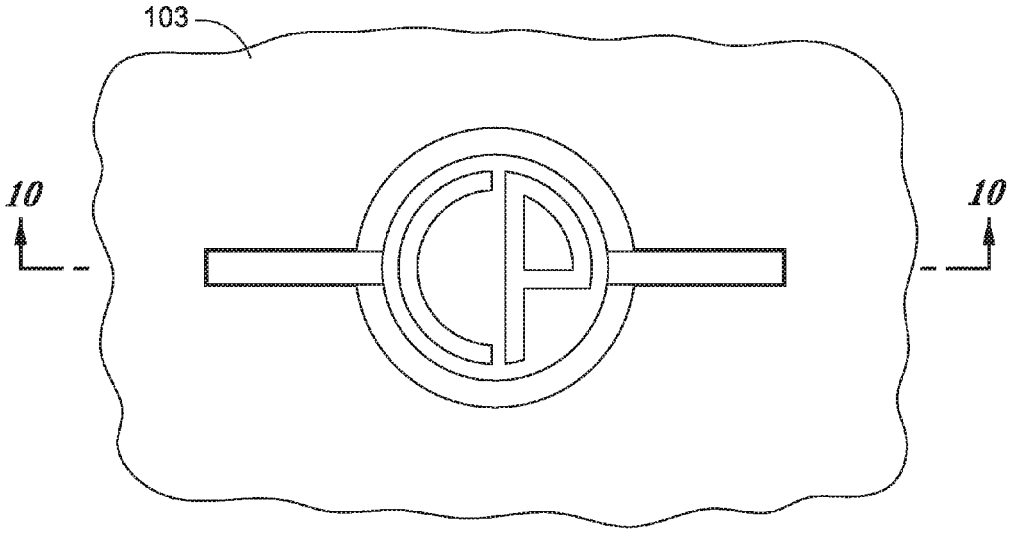
FIG. 17 is a top view of the apparatus depicted in FIG. 11 or FIG. 14, used to fill a hole.

FIG. 13 is a cross-sectional side view of the embodiment of the apparatus depicted in FIG. 12, which shows how support component locks into place within concrete housing 101*a* of precast plug 101. The location of the cross section is indicated in FIG. 17 by the 10-10 cross-section line. This embodiment of support component 151 is embedded within the concrete housing so that a cross-section of the concrete housing with the embedded support component includes a first plurality of vertically oriented cross-sections 153 of support component 151 running parallel to a second plurality of vertically oriented cross-sections 154 of support component 151, situated below a cross-section of rod 150. Further, a cross-section 155 of support component 151 is shown in FIG. 13, corresponding to a top portion of support component 151, which wraps around or hooks onto rod 150 at a middle bent portion of the rod.

Figure 14:
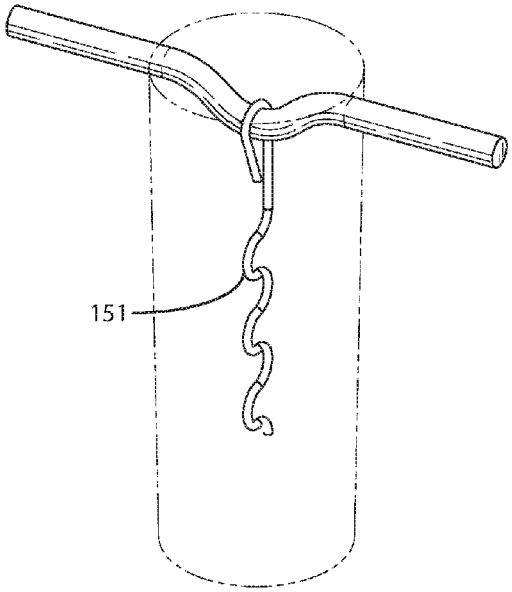
FIG. 14 is a perspective view of the apparatus depicted in FIG. 11, which includes another embodiment of a supporting component coupled to the rod.
Figure 15:
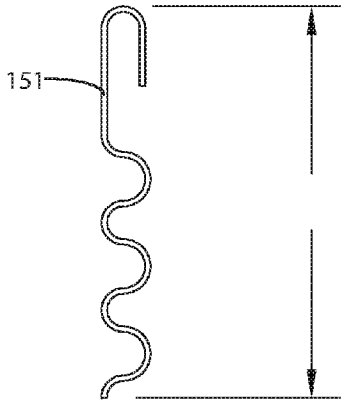
FIG. 15 is a side-view of the supporting component depicted in FIG. 14.

FIG. 14 is a perspective view of the apparatus depicted in FIG. 11, which includes another embodiment of a support component 151 coupled to rod 150. In this embodiment, support component 151 may be a rod with a smaller diameter and shaped in a manner so that the support component 151 forms a plurality of curves situated and aligned along a single plane (i.e. flat) as depicted in FIG. 14 and FIG. 15. A top portion of support component 151 may be configured to wrap around or hook onto rod 150. FIG. 15 is a side-view of the support component depicted in FIG. 14. Although this embodiment of support component 151 is shown as flat (wherein all curving elements of support component 151 are situated in a single plane), in other embodiments, each curving portion may be situated in alternating planes or different planes, without deviating from the scope of the present invention.

Figure 16:
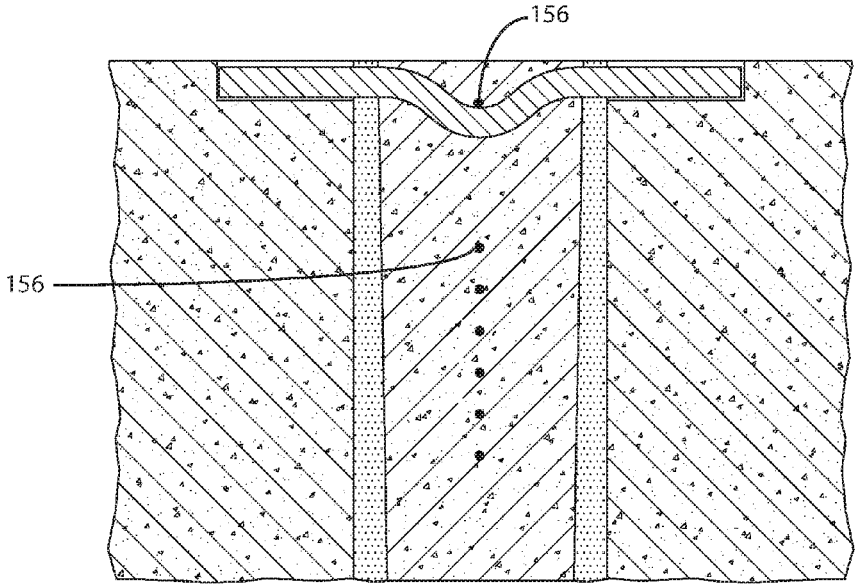
FIG. 16 is a cross-sectional side view of the embodiment of the apparatus depicted in FIG. 14 and FIG. 15.

FIG. 16 is a cross-sectional side view of the embodiment of the apparatus depicted in FIG. 14 and FIG. 15. The location of the cross section is indicated in FIG. 17 by the 10-10 cross-section line. This embodiment of support component 151 is embedded within the concrete housing so that a cross-section of the concrete housing with the embedded support component includes a plurality of cross-sections 156 that form a single vertical line substantially directly below cross-section 157 of support component 151, corresponding to a top portion of support component 151.

Turning now to the next set of figures, FIG. 11(*a*) is a perspective view of yet another embodiment of an apparatus similar to the apparatus depicted in FIG. 11; FIG. 11(*b*) is a cross-sectional side view of the embodiment of the apparatus depicted in FIG. 11(*a*); and FIG. 11(*c*) is a three-dimensional exploded cross-section view depicting the apparatus illustrated in FIGS. 11(*a*)-11(*b*), before it is place in said hole. In this exemplary embodiment, the support component coupled to the rod may be second straight rod rather than a spiraling rod. More specifically, these figures show a slim concrete housing 101 comprising a first rod 150 situated within the concrete housing 101, the first rod including a first protruding end 150*a* and a second protruding end 150*b*, each protruding from the concrete housing, wherein the first protruding end 150*a* and the second protruding end 150*b* are configured to register with grooves 107 on the surface of the floor 103 adjacent to the hole 102; and a second rod 151 coupled substantially perpendicular to the first rod 150, the second rod entirely embedded within the concrete housing 101.

In one exemplary embodiment, the second rod is coupled to the first rod at a bent middle portion of the first rod as shown in FIG. 11(*a*). In one exemplary embodiment, the first rod comprises a circular cross-section as shown in FIG. 11(*a*)-11(*c*). In yet another embodiment, the first rod comprises a rectangular cross-section similar to the top portion of the plastic "T" bar depicted in FIG. 10. In such embodiment, rod 150 may be comprised of a rectangular rod, or a rod having a substantially rectangular cross-section similar to the top portion of the plastic "T" depicted in FIGS. 9-10 and the second rod 151 may be a substantially perpendicular rod having a circular cross-section (as the rod 151 shown in FIG. 11(*a*)) and further include a bar with a break away joint at the "T" intersection (or point where the second rod couples to the first rod) similar to the breakaway joint and base of the "T" of rod 104 of FIG. 9-10. Moreover, in such embodiment, the second rod 151 may include a cylindrical arrow-like shape or anchor. Such embodiments allow for the second rod to grip the housing of precast plug, providing additional support as mentioned above.

FIG. 17 is a top view of the apparatus depicted in FIG. 11-FIG. 14, used to fill a hole. As may be appreciated, the embodiments discussed with reference to FIG. 11-FIG. 16 differ internally due to support component 151, and externally merely due to the size of housing 101*a*.

Figure 18:
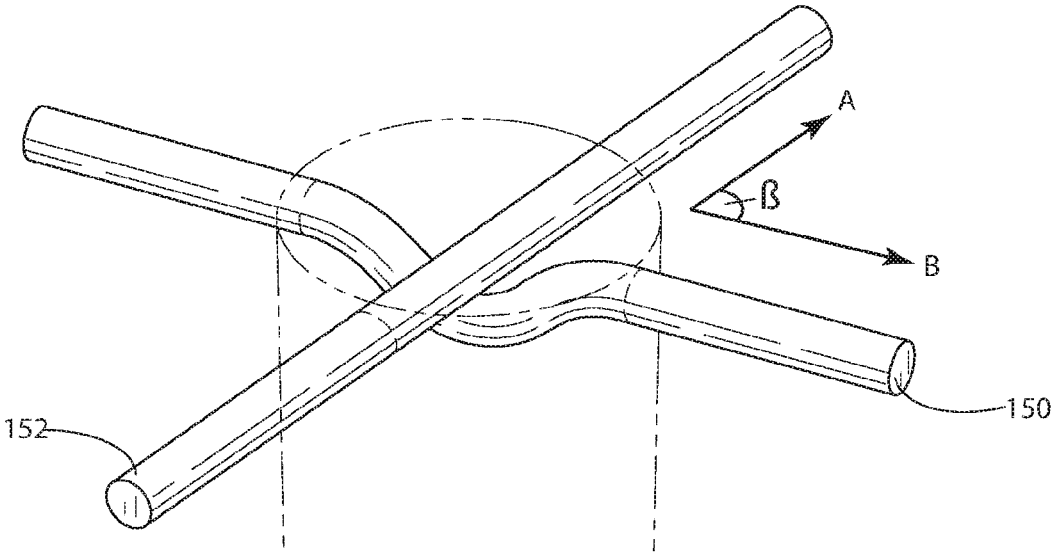
FIG. 18 is a perspective view of another exemplary embodiment, wherein an additional support rod is used.
Figure 19:
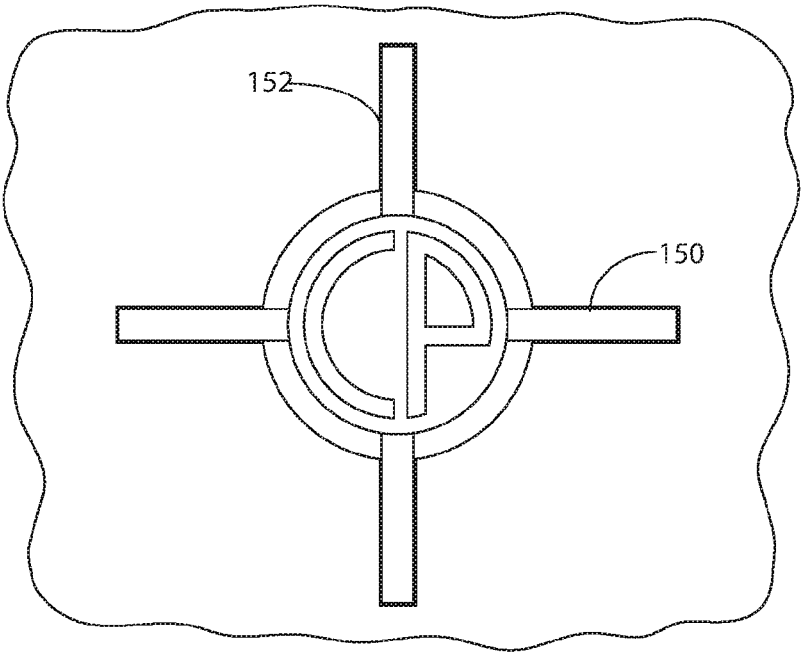
FIG. 19 is a top view of the apparatus depicted in FIG. 18, used to fill a hole.

FIG. 18 is a perspective view of another exemplary embodiment, wherein an additional support rod is used. This configuration may be desirable for additional support in situation in which, for example, an odd-shaped hole must be filled and fire-proofed. In this embodiment, a second rod 152 may be utilized, wherein the second rod is crossed over the first rod 150 in a manner so that it sits atop a portion of rod 150 (e.g. over the bend or dip on rod 150). In some embodiments, rods 150 and 152 may be positioned so that they each lay substantially horizontally or longitudinally along the top planar surface of the concrete housing of precast plug 101, and are perpendicular to each other so that an angle β along lines A and B (parallel to rods 152 and 150, respectively) forms a ninety-degree angle. In other embodiments, rods 150 and 152 may be positioned so that they cross at an angle β other than a ninety-degree angle. FIG. 19 is a top view of the apparatus depicted in FIG. 18, used to fill a hole—this embodiment showing rods 152 and 150 perpendicular to each other.

Figure 20:
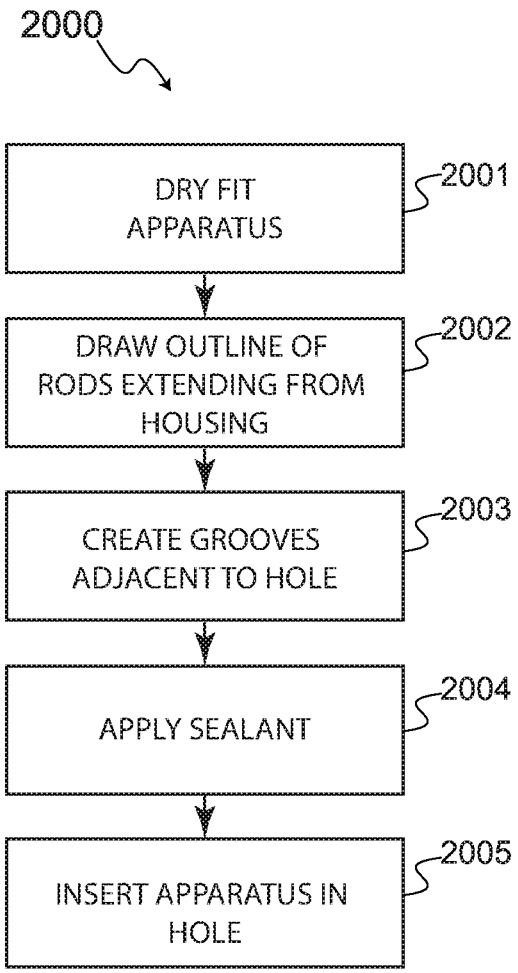
FIG. 20 is a flow-chart describing one exemplary method for filling a hole in accordance with practice of the present invention.

Turning now to the last set of figures, FIG. 20 is a flow-chart describing one exemplary method for filling a hole in accordance with practice of the present invention, more specifically, the flow-chart depicts method 2000 for filling a hole using a precast plug for which installation may be achieved from above a floor assembly; method 2000 may comprise of several steps as follows:

In step 2001, an apparatus in accordance with the present invention such as a precast plug may be dry fit into a hole of a floor assembly from above. For example, a precast plug comprising of a concrete housing and a rod partially situated within the concrete housing, may be simply placed inside the hole to make sure that the correct size housing is being utilized.

In step 2002, outlines of the rods that extend beyond the concrete housing may be drawn so as to determine the location of the grooves to be carved adjacent to the hole. Once marked, the precast plug may be removed and set aside. In this step, an installer may desire to install temporary material within the hole in order to prevent grinding dust or debris from falling through the empty hole. Notably, step 2001 may not be necessary for several reasons—for example, a template or other guidelines for outlining where the grooves may be placed on the floor surface adjacent to the hole may be used so that a dry fit is unnecessary.

In step 2003, a grinder or other tools may be used to grind or carve the grooves or slots for receiving the outer portions (or wings) of the rod (or rods) external to the concrete housing. In some embodiments, this step may include grinding slots in the floor that are approximately 5/16 of an inch deep and of sufficient length to allow the precast plug to rest slightly below the surface of the floor or in a manner so that installation of the precast plug results in a top surface of the apparatus being flush with the surface of the floor. Removal of the temporary material used to plug the hole may be required if this precaution was taken in step 2002.

Moreover, this step may further include dry fitting the precast plug again to be sure the entire apparatus rests below surface of floor or is otherwise flush with the surface of the floor adjacent to the hole. Afterwards, the precast plug may be removed and the interior walls of the floor's hole may be wiped cleaned with a damp sponge, rag or paper towel to remove debris.

In step 2004, sealant may be applied. In exemplary practice, a bead of sealant (of approximately on-half inch thickness) may be applied below the top of the hole. In some embodiments, a spreader may be used to spread the sealant around the entire internal circumference of the hole. Furthermore, a similar thickness of sealant may be applied to the circumference of the concrete housing of the precast plug, particularly to the bottom circumference of the concrete housing then spreading throughout the entire circumference or outer walls of the concrete housing.

In step 2005, the precast plug may be inserted into the hole using a twisting motion into the concrete housing so that the protruding portions of the rod (or rods) rest in the previously carved out grooves or slots, allowing the entire precast plug to rest slightly below the surface of the floor. A spreader may be used in this step to level and remove any sealant that protrudes above the surface of the floor. In order to facilitate installation inspection, an installer may desire to keep the top surface of the precast plug clean (especially when the top portion may include a logo and other information relevant for inspection).

Figure 21:
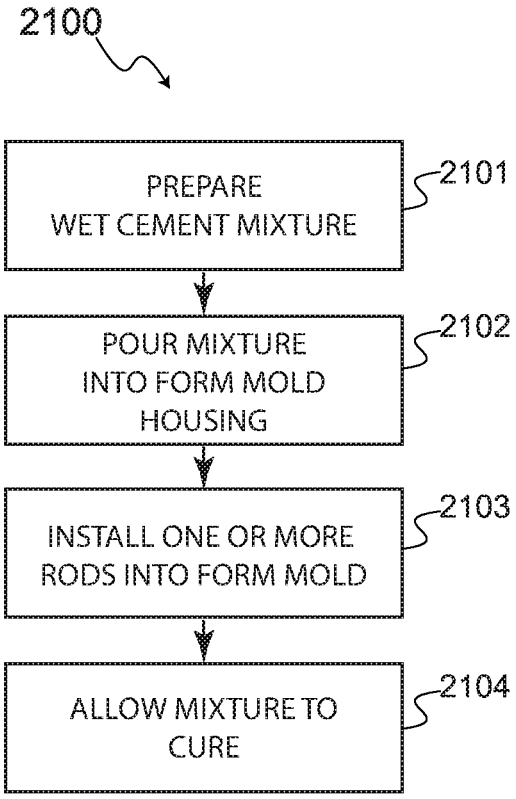
FIG. 21 is a flow-chart describing one exemplary method for creating an apparatus in accordance with the present invention.

Now turning to the last figure, FIG. 21 is a flow-chart describing one exemplary method for creating an apparatus in accordance with the present invention, the flow-chart depicts method 2100 for creating or constructing a precast plug; method 2100 may comprise of several steps as follows:

In step 2001, a wet cement mixture may be prepared. In step 2002, the wet cement mixture may be poured into a form mold housing for creating the concrete housing of the precast plug.

In step 2003, one or more rods may be installed into the form mold housing whereby a distal end of one of the one or more rods makes a first protrusion from a first edge of said form mold housing and the proximal end of the rod makes a second protrusion from a second edge of the form mold housing. This step may be repeated depending on whether a single or multiple rods will be implemented with the precast plug being created. In alternative embodiments, the one or more rods may be positioned on the form mold housing prior to pouring the wet cement mixture.

In step 2004, the mixture may be allowed to cure with said the one or more rods in place, thereby creating said precast plug. This step may also include embossing the precast plug with a logo and or a size indicator, or stamping the precast plug with a logo and a size indicator, or otherwise including any pertinent inspection-relevant information onto the concrete housing as the cement mixture cures.

Naturally, the steps above should not be limiting, and these steps and additional steps may be performed in the same sequence or alternative sequence without deviating from the scope of the present invention. As may be appreciated by a person of ordinary skill in the art, one of the advantages of the present invention is that an apparatus to fill and fire-proof a hole in a concrete floor may be achieved with installation from above. Typically, in order to meet the requirements under well-known standards access from below a floor assembly is required. As described above, an apparatus in accordance with the present invention may be simply placed inside the hole, sealed using certain sealants, and adjusted so that it is flushed with the surface of the floor adjacent to the hole.

A method and apparatus for filling and fire-proofing holes in concrete floors has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. An apparatus for sealing a hole, comprising:

a concrete housing configured to substantially seal a hole in a floor of a building;

a first rod situated within the concrete housing, the first rod including a first protruding end and a second protruding end, each protruding from the concrete housing, wherein the first protruding end and the second protruding end are configured to register with one or more grooves on a surface of the floor adjacent to the hole; and a second rod, coupled substantially perpendicular to the first rod, the second rod entirely embedded within the concrete housing, wherein the concrete housing is cylindrically shaped, tapers inward and includes a top planar surface, an outer wall, and a bottom planar surface that are integral to and unitarily form the concrete housing.

2. The apparatus of claim 1, wherein the second rod is coupled to the first rod at a bent middle portion of the first rod.

3. The apparatus of claim 1, wherein the first rod comprises a circular cross-section.

4. The apparatus of claim 1, wherein the first rod comprises a rectangular cross-section.

5. The apparatus of claim 1, wherein the second rod comprises a terminal end with an anchor.

6. The apparatus of claim 1, wherein the second rod comprises a circular cross-section.

7. The apparatus of claim 1, wherein, the top planar surface of the concrete housing is parallel to the bottom planar surface of the concrete housing.

8. The apparatus of claim 1, further comprising a sealant on the outer wall of the concrete housing.

9. The apparatus of claim 1, wherein the first protruding end and the second protruding end of the first rod situated external to the concrete housing are substantially flush with the top planar surface of the concrete housing.

10. The apparatus of claim 1, wherein the height of the concrete housing is the minimum height of the hole.

11. The apparatus of claim 1, further comprising a batch control number embossed on the concrete housing.

12. The apparatus of claim 1, further comprising a batch control number stamped on the concrete housing.

13. An apparatus for sealing a hole, comprising:

a concrete housing configured to substantially seal a hole in a floor of a building;

a first rod situated within the concrete housing, the first rod including a first protruding end and a second protruding end, each protruding from the concrete housing, wherein the first protruding end and the second protruding end are configured to register with one or more grooves on a surface of the floor adjacent to the hole; and a second rod coupled substantially perpendicular to the first rod, the second rod entirely embedded within the concrete housing, wherein the second rod is coupled to the first rod at a bent middle portion of the first rod.

14. The apparatus of claim 13, wherein the concrete housing includes a top planar surface, an outer wall, and a bottom planar surface that are integral to and unitarily form the concrete housing.

15. The apparatus of claim 14, wherein, the top planar surface of the concrete housing is parallel to the bottom planar surface of the concrete housing.

16. The apparatus of claim 14, further comprising a sealant on the outer wall of the concrete housing.

17. The apparatus of claim 14, wherein the first protruding end and the second protruding end of the first rod situated external to the concrete housing are substantially flush with the top planar surface of the concrete housing.

18. The apparatus of claim 14, wherein the concrete housing is cylindrically shaped and tapers inward.

* * * * *